US010743722B2

(12) United States Patent
Mitra et al.

(10) Patent No.: US 10,743,722 B2
(45) Date of Patent: Aug. 18, 2020

(54) DEVICES AND METHODS TO MAINTAIN PERSONAL HYGIENE WHILE USING THE TOILET

(71) Applicants: Hirak Mitra, Santa Clara, CA (US); Donald C. Lewis, Richmond, CA (US)

(72) Inventors: Hirak Mitra, Santa Clara, CA (US); Donald C. Lewis, Richmond, CA (US)

( * ) Notice: Subject to any disclaimer, the term of this patent is extended or adjusted under 35 U.S.C. 154(b) by 318 days.

(21) Appl. No.: 14/797,683

(22) Filed: Jul. 13, 2015

(65) Prior Publication Data

US 2017/0015482 A1 Jan. 19, 2017

(51) Int. Cl.

*A45D 34/00* (2006.01)
*A47K 10/32* (2006.01)
*A47K 17/00* (2006.01)

(52) U.S. Cl.

CPC ..... *A47K 10/32* (2013.01); *A47K 17/00* (2013.01); *A47K 2010/3273* (2013.01)

(58) Field of Classification Search

CPC ..... B41K 1/54; B41K 1/46; B43M 11/04
See application file for complete search history.

(56) References Cited

U.S. PATENT DOCUMENTS 1,782,505 A * 11/1930 Harris ..... B43M 11/04 118/270
2,117,470 A * 5/1938 Zareko ..... B41K 1/46 101/201
5,357,861 A * 10/1994 d'Arbelles et al. ..... B41K 1/00 101/327
6,167,807 B1 * 1/2001 Maggio ..... A63H 33/3083 101/333
8,077,555 B1 * 12/2011 Lovato ..... A47L 13/16 15/244.4
2006/0261091 A1 * 11/2006 Kadiks ..... B05B 11/0005 222/156

FOREIGN PATENT DOCUMENTS

CA 1174018 A * 9/1984 ..... A45D 29/17
CH 200690 A * 10/1938 ..... B43M 11/04
DE 1960556 A1 * 6/1971 ..... B41K 1/46
DE 2812146 A1 * 9/1979 ..... A45D 34/00
GB 191307578 A * 3/1914 ..... B43M 11/04

OTHER PUBLICATIONS

DE_2812146_translation.pdf.*
CH_200690_translation.pdf.*

* cited by examiner

*Primary Examiner* — Allan D Stevens

(57) ABSTRACT

A container holds an absorbent pad which contains fluids for cleansing toilet facilities before using them, or for cleansing or moisturizing a person's body after using a toilet. One carries one or more such containers on one's person. To use the container one opens it and expresses fluid from the pad onto dry clean toilet paper by pressing that toilet paper onto the pad. One then uses the now moist toilet paper to clean a toilet seat, or to clean or moisturize one's person or the person of another. Then one disposes of the now used toilet paper as one normally disposes of toilet paper.

4 Claims, 11 Drawing Sheets

DEVICES AND METHODS TO MAINTAIN PERSONAL HYGIENE WHILE USING THE TOILET

PRIORITY

This application claims priority from U.S. Provisional Patent Application No. 62/025,496 filed Jul. 17, 2014, the contents of which are incorporated herein by reference.

DEFINITIONS

Excreta are matter excreted by the body, including but not limited to urine, fecal matter and emesis.

To excrete is to void excreta.

The affected skin is the area of a person's body which a person may rub with toilet paper to clean it because it holds residual excreta and other debris on its surface.

To wipe is to rub affected skin to clean it, potentially removing residual excreta and other debris.

Unblocked refers to a plane or a space through which solid objects and fluids can readily travel.

Blocked refers to a plane or a space through which solid objects and fluids cannot readily travel.

A chamber is an enclosure inside a container adapted to hold objects and fluids. A chamber contains an unblocked continuous open volume enclosed within a container, through which solids and fluids move without deforming their shape or the shape of the chamber.

A lid is a blocked closure on a chamber within a container. The aperture of the chamber under a lid is an opening of the container adapted to allow objects outside the container to impinge upon objects inside the container. The lid closes externally to this aperture.

The face of a chamber of a container is a part of the container that separates from the rest of the container to provide unblocked access to the interior of the chamber through which objects held inside the chamber may travel in and out of the chamber. In such a case the window is the opening the face reveals when it moves aside. Note in some embodiments a face and a lid are the same component—in which case the aperture and window are also the same—while in other cases they differ.

An internal sleeve is a piece of a container adapted to hold a plurality of objects in a chamber, and to slide in and out of the housing of the container. When the internal sleeve has slid out as far as it goes then objects outside the container are able to impinge on objects held in the sleeve.

When the lid, face or sleeve is open it exposes the chamber to objects and substances outside the container.

When a lid, face or sleeve is closed it does not expose the chamber to objects and substances outside the container, at least through that particular feature.

A leak-resistant face, lid or sleeve is one that when closed disallows fluid to leak through it.

A container contains a plurality of chambers. Each such chamber has some means of allowing objects outside of the chamber to touch objects inside the chamber. Any lid, face or sleeve of a chamber of similar features for a different chamber; or, depending on geometry, multiple chambers may share a single such feature. Different chambers do not leak into each other. Each chamber is leak-resistant to the exterior of that chamber when all lids, faces, sleeves or other openings to that chamber are closed.

The container body is, in relation to some part of the container, all other parts of the case besides the that part as a unit.

A pad is an object, part or all of which is a reservoir of absorbent material manufactured to a particular shape.

A kit comprises a container and a plurality of pads which have been manufactured such that each different pad fits inside a different chamber, such that when the kit is assembled, each chamber has exactly one pad inside it.

Reservoir fluid is the fluid which a pad holds.

A fill mark is a visual or geometric mark in a container to show how much fluid to pour into the container. A fill mark can indicate a minimum fill level or maximum fill level.

A choke point is a geometric restriction inside a container that precludes a pad inside the container from coming out of its chamber without deforming from its manufactured shape or deforming the container from its manufactured shape.

The user is the person using the kit to perform work on the user's person, on the person of another, or on some other thing.

A use facility is a physical locale where the user performs cleansing functions.

Toilet cleaner fluid is a fluid adapted to clean toilet seats.

Skin cleaner fluid is a fluid adapted to cleanse a person's skin.

Lotion is a fluid adapted to moisturize skin.

A toilet paper pocket is a closed or partially closed space on a container which is adapted to hold dry toilet paper, and which is separated from any chamber of the container so that no fluid leaks into it from any chamber.

FIELD AND BACKGROUND

This pertains to the field of keeping oneself or another clean while and after urinating, defecating or otherwise excreting, in public or private use facilities such as lavatories and baby changing stations.

The traditional approach to cleaning one's own person is to sit down on a toilet seat, to excrete, and then to use dry toilet paper to wipe one's affected skin, and then throw that soiled toilet paper down the toilet. This is what most people do most of the time in North America.

An extension to this approach is to this is to cover in some way the toilet seat or other surface which will touch the skin, thereby attempting to prevent skin from touching excreta and other debris already present on the toilet seat or other surface.

The traditional approach to cleaning oneself or somebody else who has soiled himself and needs to be cleaned, is to remove a soiled diaper, other apparel or both, to wipe clean that individual's affected skin, and then to dispose properly of the soiled diaper, other apparel, and the toilet paper or other implement used for wiping. A lavatory and its toilet, or similar use facility, are often but not always pertinent to this cleaning.

The Problem and the Prior Art

There are three problems with the cited, traditional approaches.

The First Problem

The first problem with the traditional approach is that one might sit down on an unclean toilet seat. In fact, even if prior users of the toilet seat were conscientious and did not leave excreta on the seat, then the flushing action of the toilet itself may still cause some toilet water, including excreta and quite possibly pathogens, to spray back up and onto the seat. This is unclean and also may promote the spread of infectious diseases.

Similarly if one is changing another, for instance a baby, then the surface on which one sets that other person may hold prior excreta or other debris.

Prior Art for the First Problem

The most obvious answer to avoid the first problem is to wipe the toilet seat or other surface clean before sitting on it, or placing another person on it. But most public use facilities do not have any means of cleaning such surfaces except for dry toilet paper, which will simply partly absorb and partly smear any excreta and other matter already present onto the seat.

A better answer is to use pre-moistened wipes which contain some sanitizing cleanser to wipe the surface clean. However, this requires that one carry these pre-moistened wipes around to be used when one goes to the use facility. These items are bulky and somewhat heavy because they contain cellulose soaked in fluid. Also, one may not dispose of these pre-moistened wipes in a toilet, since they are not designed to break down in a sewage system, but to remain intact indefinitely in their moist form.

Alternately one may carry a bottle of cleaner and, before one uses a toilet or other surface, apply some of this cleaner to toilet paper, and then use that moistened toilet paper to wipe the toilet seat or other surface clean before sitting down on it or placing another on it. However, bottles containing fluids pose spill and propelled fluid hazards while being carried, and also during the discharge of their contents.

Another technique is to use a toilet seat cover to cover a toilet seat, or a surface cover to cover a surface where one places somebody. However such covers are not always readily available. And they are clumsy and prone to slip.

The Second Problem

The second problem with the traditional approach is that after a person excretes, wiping the affected skin dry with dry toilet paper does not completely clean the body. Dry toilet paper smears excreta over affected skin where the user rubs toilet paper, since that dry toilet paper lacks any addition of solvent and cleansers to clean and to sanitize more thoroughly. This too is unhygienic. Also, dry toilet paper is rough and when one rubs it repeatedly over the affected skin in an attempt to clean the affected skin completely, one may abrade the affected skin to the point of breaking it, thus exposing oneself to a risk of sepsis from excreta that one has failed to cleanse completely.

Prior Art for the Second Problem

The most obvious method to avoid to the second problem is to use moist toilet paper to wipe. This is easy to do in private use facilities where water is provided in the toilet enclosure or other cleaning area. One only need wet some toilet paper with water and also perhaps soaps or antiseptics before wiping the affected skin with that moistened toilet paper. This will more effectively cleanse the affected skin, than dry toilet paper alone would cleanse it. Also moist toilet paper is less abrasive than dry toilet paper, and therefore less likely to break one's skin when one wipes the affected skin. However, this method does not address the situation where one is away from home, perhaps in a toilet stall with no source of water, let alone soap or antiseptics.

A second obvious method is to use pre-moistened wipes, to wipe the affected skin. To use pre-moistened wipes, one simply removes such a pre-moistened wipe from a package. Then one uses it and discards it. However, this approach has a number of disadvantages. First, to use such pre-moistened wipes one must purchase or otherwise procure them before one uses them, and then carry these around. Second, one must have these pre-moistened wipes present and within reach at the point one is seated on a toilet and needs to wipe one's affected skin. Third, such pre-moistened wipes may not be readily available in all locales. Fourth, the moistening solutions used may be of unknown compounding and may contain materials inappropriate for use on human skin. Fifth, the user can only use a pre-moistened wipe once, and then must discard it. Such pre-moistened wipes are not available in most use facilities, so to use them the user must bring them. Also a user must discard such pre-moistened wipes after one use; the user cannot reuse such pre-moistened wipes. This is inefficient compared to systems and methods which do not require the user to discard the system's primary articles with each use.

Finally, these pre-moistened wipes do not always work well with, and are not recommended for disposal in, toilets and the sewage system. Some, such as those sold explicitly for babies, were never meant to be flushed, but rather thrown away with soiled diapers in a garbage receptacle. Accordingly these do not break down in water like toilet paper does. As such the user may not even dispose of them in many toilet stalls, which typically do not have a garbage receptacle apart from the toilet itself. Other disposable pre-moistened wipes, meant for adults, are advertised as flushable but these never break down. Instead they maintain their structural integrity, and thereby present a risk of clogging the sewage system. This stands to reason, since such a stabilized cellulose product is meant to remain moist in its container without degrading until it is used. But if so, such a product is also sturdy enough that it fails to break down in the sewage system. To be fair, some such pre-moistened wipes are configured to pass through the sewer pipes more readily and so do not cause a clog in the local sewage system even though they do not break down.

In some methods one attaches some sort of moistening device to the toilet apparatus itself. This method is useful if and only if one can control the use facility aspects in all usage scenarios; this is frequently not possible. Also in this scenario the moistening fluid is not controlled by the user, but by the use facility provider.

The Third Problem

The third problem with the traditional approach is that cleaning a person's affected skin by rubbing it with paper leaves it dry and may irritate it, particularly if the cleaning process itself abrades the affected skin.

Prior Art for the Third Problem

The most obvious method to correct to the problem of having a dry affected skin, is to carry around a bottle of lotion. After cleaning oneself or another one applies this lotion either to toilet paper and applies that toilet paper to the affected skin; or to one's hand, and then uses that hand to rub that lotion over the affected skin. The problem is it is inconvenient to carry around a bottle of lotion. There are easier ways to carry lotion. We present one such alternative method here.

Summary of the Problems

Clearly a better approach than this for all three problems—cleaning the toilet seat and other surfaces prior to use, cleaning one's body or the body of another after voiding excreta, and applying lotion to oneself or to somebody else, is to use existing toilet paper, which is known to degrade in sewage systems; but to make that toilet paper moist, even when one is away from a private venue and moistening agents or means are not provided by the venue. Also, it would be better for the user to be able to choose what fluids or fluid compounds to use to solve these problems.

In other methods the user carries some sort of bottle which holds some solution that the user sprays or otherwise applies to toilet paper at the point the user uses that toilet paper. This method has merit in that it enables the user to moisten toilet paper the user finds within the use facility, and therefore clean more thoroughly with that toilet paper. But it requires the user to carry such a bottle when the user visits the toilet. Such known bottles have a higher likelihood of leaking or projecting fluid from their dispensing orifice than the novel devices described herein. The devices presented here, and the methods combined herein, are superior to such bottles because said devices will not leak. The devices disclosed here are specifically configured to prevent leakage under normal transport and use conditions.

SUMMARY OF THE INVENTION

Here are disclosed devices and methods for personal hygiene.

A device holds and dispenses fluids used for personal hygiene including cleaning toilet seats, cleaning one's person and moisturizing one's person. This device holds advantages over existing devices in its portability, in its simplicity of design, in that it does not pressurize nor propel fluid, and that it reabsorbs rather than spills unused fluid.

This device comprises a container which holds a pad, and this pad holds a fluid.

In some embodiments the container is lidded and leak-resistant.

In some embodiments the pad is malleable and fluid-absorbing.

The container has no open space inside it to hold such fluid in a form where this fluid flows freely without coming into contact with the pad. The intent of this is: For normal operation, if there is free fluid inside the case, that such fluid is absorbed by the pad. It is to be noted that such absorption may be incomplete because it takes time, imperfections and geometric features may cause drops of fluid not always to roll to the pad, and also if more fluid exists in the chamber than the pad can absorb.

In some embodiments the fluid a pad holds can be used to clean a toilet seat. In some embodiments the fluid a pad holds can be used to cleanse a person's body of excreta and other debris. In some embodiments the fluid a pad holds can be used to moisturize a person's body. In some embodiments the fluid a pad holds can be used to perform more than one of these functions.

In some embodiments a pad completely fills the chamber it occupies inside the case, and in some embodiments it does not completely fill the chamber it occupies inside the case.

In some embodiments an impinging object applying pressure to the pad causes the pad to express some of the fluid it holds, partially upon the impinging object. In some embodiment this action deforms the pad and in some embodiments this does not.

In some embodiments the container is lidded. In some further embodiments when opened the lid exposes the pad to objects outside the container, and this allows an object to impinge upon the pad. After this impingement ceases the pad reabsorbs the excess fluid remaining in the container but outside the pad, so that in the steady state no fluid flows freely inside the container.

In some embodiments the amount of fluid the pad expresses generally increases with the amount of force impinging upon it. In some other embodiments it does not, for instance if the pad is stiff and not malleable, in which case fluid still transfers from the pad to other objects by capillary action but not due to compression of the pad.

In some embodiments where the container is lidded a user opens a lid and impinges dry toilet paper upon the pad, the pad expresses onto the toilet paper some of the fluid the pad holds, and the toilet paper then absorbs this fluid. When the fluid is for cleaning toilet seats and other surfaces, the moistened toilet paper is now better suited to the task of cleaning such surfaces. When the fluid is for cleaning a person's skin, the moistened toilet paper is now better suited to the task of cleaning skin. And when the fluid contains lotion the moistened toilet paper is now suited to the task of moisturizing skin, where before being moistened it was not thus suited.

More specifically:

A container contains one or more absorbent pads. The container contains each pad in its own chamber. Each chamber has a lid. These chambers do not leak between each other, and do not leak outside the container unless its lid is open.

Different pads hold fluids for different purposes:

- A pad can hold a fluid called toilet cleaner fluid to clean toilet seats.
- A pad can hold a fluid called skin cleaner fluid, to cleanse the user's skin after purgative bodily functions.
- A pad can hold fluid, called lotion, to moisturize the user's affected skin after wiping with the second fluid.

When the user visits a use facility, the user carries one or more of these containers.

In a typical usage case for the invention: First the user expresses the toilet cleaner fluid to moisten some toilet paper and then to use that moistened toilet paper to clean the toilet seat. Then the user throws away the used toilet paper into the toilet. Then after the user performs bodily functions into the toilet, the user expresses skin cleaner fluid to moisten some toilet paper, and then uses the now moistened toilet paper to clean the user's own person. Then the user throws away that used toilet paper in the toilet. Finally, if desired, the user expresses lotion onto fresh dry toilet paper, and then applies the toilet paper to the user's affected skin to moisturize that skin. Then the user disposes of that toilet paper in the toilet. Then the user flushes the toilet to get rid of all the used toilet paper and also the user's human waste.

Prior Art for the Method and Devices

Stamp Moistener

A stamp moistener, as used in postage application to letters and packages, is an existing device that comprises a container which contains an absorbent pad. This absorbent pad holds water or some other moistener fluid. A stamp holds dry glue on its back surface. To moisten the stamp the user applies this surface to the absorbent pad, thereby transferring some of said fluid onto the back face of the stamp, thereby moistening the dry glue on the stamp and thus activating it as a glue, thereby enabling the user to apply said stamp onto the surface of an envelope or package and making it adhere to that surface. When the stamp moistener container is closed it is leak-resistant, in that liquids inside this container do not spill out. However, many examples of stamp moistener containers are not leak-resistant, and over time the fluid held inside the absorbent pad in the container may evaporate away. The absorbent pad does not shed the fluid it holds until some surface presses against it. The combination of the geometry of the container and the absorbent pad prevents the fluid from leaking or spilling outside the container. When a surface does impinge against the absorbent pad, the pad expresses some fluid onto that surface.

The absorbent pad in such a container is resilient. It does not express fluid if nothing impinges upon it. But pressure against such a pad expresses fluid from the pad onto the object applying pressure. Also these containers may have screw-on lids or latching lids, so that when closed they are resistant being opened by to casual contact.

The devices presented here are different from a stamp moistener because:

- These devices are designed to moisten an intermediary means of application which are used to clean, rather than to be cleaning instruments themselves. This leaves the kit itself untainted by excreta.
- These devices are designed such that a pad once inside of a container does not fall out without external force deforming it.
- These devices hold fluids adapted to purposes other than moistening stamps.

Envelope Moistener and Fingertip Moistener

An envelope moistener, as used to moisten the glue on an envelope prior to gluing it shut, is a device that is adapted not to leak, drip or otherwise express fluid except when pressed against some object.

A fingertip moistener is an existing device that comprises a container which contains an absorbent pad which holds water or other moisturizer. Its is functionally identical to a stamp moistener, but instead of applying a stamp to the absorbent pad the user applies the user's fingertip to it, thereby moistening said fingertip.

The devices presented here differ from an envelope moistener or a fingertip moistener because:

- These devices are not adapted to applying the fluid they hold onto some other instrument for cleaning.
- These devices hold fluids adapted to purposes other than moistening envelopes or fingertips.

Felt-Tip Pen

A felt tip pen may contain some elements of the present invention including leak-resistant container and a pad soaked in fluid. But it differs from the devices presented here in the following ways:

- The fluids in it are adapted to rendering markings on surfaces.
- A felt tip pen is not adapted geometrically to having toilet paper pressed against it to moisten that toilet paper.
- The devices presented here hold fluids adapted to purposes other than making markings.

Pre-Moistened Wipes

Some existing containers for pre-moistened wipes are also prior art, since this type of container has some of the functionality of our device. The devices presented here differ from containers for pre-moistened wipes in what the container contains. Both containers for pre-moistened wipes, and the present invention, have sealing and latching lids.

In a use case of having a pre-moistened wipe container: The user opens it and pulls out a pre-moistened wipe. In a use case of having the present invention: The user opens the container and presses paper against the pad inside the chamber, thereby expressing fluid onto the paper which then carries that fluid to the point of use. The act of extracting a pre-moistened wipe may express fluid onto the exterior of the container, and onto the fingers used to extract the pre-moistened wipe from its container, since the fluid inside the container of the pre-moistened wipes permeates all surfaces inside it. Use of the pre-moistened wipe cedes control of the amount as well as constituent chemistry of the moistening agent to the manufacturer of the pre-moistened wipe, whereas in the methods disclosed in this invention the user controls the amount of fluid expressed and has the option of employing a manufacturer's constituent chemistry or the user's choices of constituent chemistry.

Existing Toilet Paper Moistener

An existing device similar to those disclosed in this invention, is different in that being that device comprises in addition to a pad a bottle, which acts as a reservoir wherein fluid flows freely. Such a device is both more complex to manufacture than the ones disclosed, and also more prone to failure since the free-flowing fluid is more liable to leak in the event the the container is compromised.

BRIEF DESCRIPTION OF DRAWINGS

In these figures things are numbered as follows.

101-199—base enclosure
201-299—closure lid
301-399—sealing features
401-499—absorbent pad
501-599—marking and identification features
601-699—auxiliary features
701-799—chamber
801-899—aperture
901-999—choke point
1001-1099—pocket
1201-1299—extension
1501-1599—fill mark

THE FIRST EMBODIMENT

Figure 1:
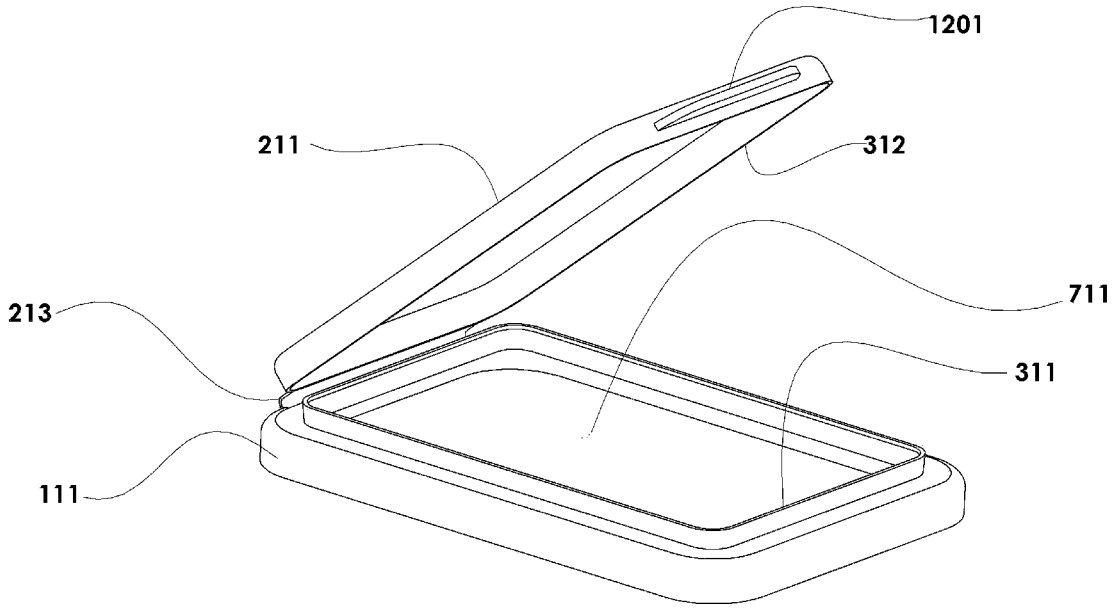
FIG. 1 illustrates an exemplar of the first embodiment. A rectangular container (111) has a chamber (711) with a lid (211) that is adapted to be opened with one hand holding the container body and a digit of the other hand pushing an inflexible lip extending from the lid (1201). When the lid is closed the rim of the lid (312) seals against the rim of the container (311) to form a leak-resistant seal. The lid attaches to the body by a hinge (213) and may latch shut when closed.
Figure 2:
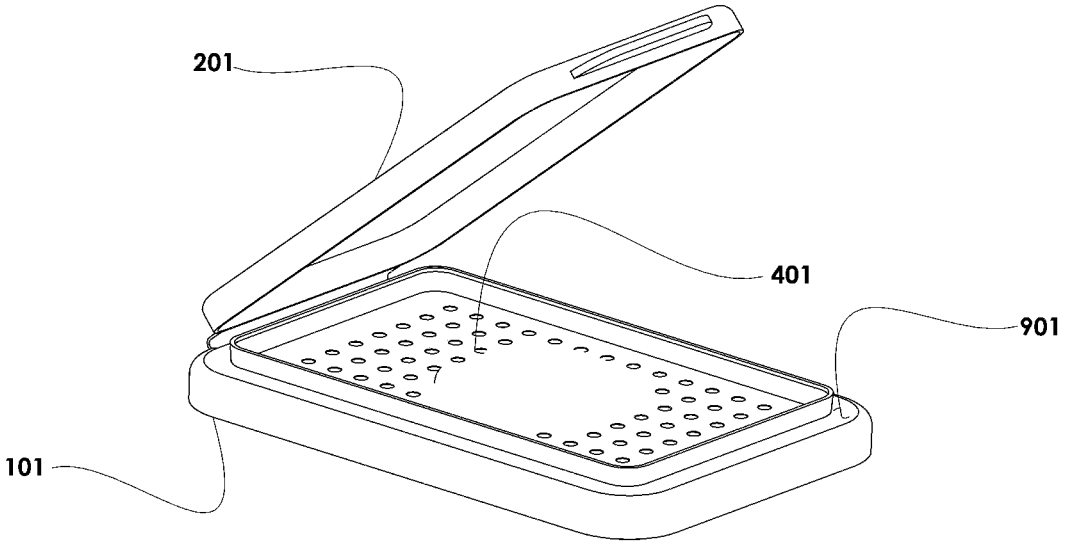
FIG. 2 illustrates a the same exemplar of the first embodiment as FIG. 1. Now a pad (401) is inside the chamber. A choke point (901) prevents pad (401) from coming out. The container body (101) and lid (201) are shown as well.

In some embodiments the user carries three small, leak-resistant flat rectangular containers, as shown in FIG. 1 and FIG. 2. Each container is square and 2.0 inches to a side, and 0.5 inches in thickness. In some other embodiments the dimensions and the shapes of said containers vary.

Each such container (121) contains a resilient, absorbent (401) in its chamber (701). This pad acts as a non-free state fluid reservoir for water or some other fluid. In each container a 90% of the area of one face of the contained pad is visible and presented through an aperture when the user opens the container by lifting the lip (1201) of the lid (211). The lid attaches to the container by a hinge (213). When the container is closed the edge of the chamber (311) forms a leak-resistant seal with edge of the lid (312).

Container

A container is either open or closed. When it is open the pad inside is exposed to being touched by other objects. When it is closed the pad inside is not thus exposed. When a container is closed the volume it encloses is leak-resistant.

Absorbent Pad

The absorbent pad, or pad, bears special note. It is sufficiently elastic and resilient that the user may pull it out of its chamber in the container through the aperture, and similarly replace it inside the container through the aperture, but when force and pressure are no longer applied to the absorbent pad to compress it in a manner allowing its extraction through the aperture then it returns to its manufactured shape. The manufactured shape of the absorbent pad is made to fit snugly inside the container. The absorbent pad retains this manufactured shape by friction controlled by lateral compression of the pad within the container, against the inner walls of its chamber. Once deformed the absorbent pad no longer possesses its manufactured shape. However, pressing against the absorbent pad through the aperture, rather than pulling it, deforms it in such a manner that it remains laterally compressed against the inner walls of its chamber, or additionally and concurrently constrained in place by geometric constraints, by compression of the pad, or by both.

Geometric Constraints

In some embodiments the absorbent pad in its manufactured shape cannot fall out of the container because its geometry will not allow it—it is too large to come out through the aperture, in all of its degrees of freedom within the chamber. The pad is prevented from fully exiting the container by at least one choke point, defined as a geometric constraint preventing the pad from fully exiting the chamber without deforming the pad.

To be mathematically precise: In the open path between the chamber of the container which contains the pad, and the exterior of the container at the aperture of that chamber, up to and including the aperture; a choke point is some planar region A of that open path such that for all possible positions of the pad in its manufactured shape and contained in the chamber, there exists a cross-section B of the pad parallel to A, such that there exists C, some non-null region of B, such that the projection of C onto the plane of A falls outside A. So C is prevented from passing through the aperture at A without deforming the geometries of the pad or the container.

In some embodiments the pad combines absorbent features with differing shape and material properties for purposes of retention, identification, extraction or facilitating manufacturing and assembly.

In some embodiments there is a choke point at the aperture itself. In some embodiments there is a choke point on the open path between the chamber and the aperture. In all such cases such a choke point prevents the pad from exiting the chamber without modifying the shape of the pad, e.g. by deforming or mutilating it.

Compression of the Pad

In its use-state form, which is its manufactured shape, the pad holds fluid. Applying pressure to the pad by impinging on it through the aperture reduces the pad volume to a volume smaller than its manufactured volume. Doing so expresses some portion of the fluid held in the pad, into the free space in the chamber and onto the surface applying pressure on the pad. If the user places the dry pad in fluid, or pours fluid on the pad, the pad absorbs the fluid by capillary action. The user may hasten this process by compressing the dry pad into a smaller than manufactured volume and then either placing it in fluid, or pouring fluid over it; as the pad reverts to its manufactured shape and volume it absorbs fluid. The user may also forcibly remove fluid from the pad by compressing it, thereby expelling the fluid it holds.

When the pad holds an appropriate volume of fluid and no pressure is applied to the pad then the pad expresses little or no fluid. When the user compresses some volume of the pad, then that volume of the pad expels fluid through all of its surfaces. If the pad is inside its container the container prevents the fluid from escaping except to an object applying pressure to the pad through the aperture, and upon cessation of such pressure the pad eventually reabsorbs any expelled fluid inside the container, apart from traces that may remain as droplets that for any reason fail to touch the pad.

Thus when the user opens the lid to the container and presses toilet paper against the pad that pressure expresses some of the fluid from the pad onto the toilet paper. We call this process moistening the toilet paper on the pad. No other fluid escapes the container and upon removal of the pressure the pad reabsorbs the expelled but not transferred fluid inside the container.

Different Containers

Three different leak-resistant containers are described.

In some embodiments all three containers may be equal in all but details of marking, identification, and the purpose of the fluid in each container. In some embodiments different containers may have different geometries. In any case functionally they may differ only in their contents and the purpose of those contents. Thus they are described as one device. A container is adapted to contain a reservoir comprising an absorbent volume. This reservoir is called a pad, which is adapted to absorb and thus hold a fluid called reservoir fluid. Together the container and the pad are called a kit.

In some embodiments the purpose of the content of the kit is to clean a toilet the container is called the toilet cleaner container, and the pad is called the toilet cleaner pad, and the reservoir fluid is called the toilet cleaner fluid. This toilet cleaner fluid is a fluid used to clean toilet seats and other parts of toilet, such fluids of varied efficacy in killing micro-organisms being well known and understood in the art. Before the user sits down at a toilet seat the user opens this container, takes some toilet paper, and moistens the toilet paper on the toilet cleaner pad. After the user thus moistens this toilet paper, the user applies this toilet paper to the toilet seat and thereby cleans the toilet seat, removing or rendering harmless most or all substances on it, including but not limited to excreta and water.

In some embodiments the purpose of the content of a kit is to cleanse, to disinfect, or to cleanse and to disinfect the affected skin after one uses the toilet, the container is called the skin cleaner container; the pad is called the skin cleaner pad; and the reservoir fluid is called the skin cleaner fluid. This skin cleaner fluid holds water, soap and a mild personal disinfectant, such fluids being well known and understood in the art. After the user finishes using the toilet, the user moistens dry toilet paper on the skin cleaner pad. The user then uses this moist toilet paper to wipe the affected skin, and disposes of the soiled toilet paper in the toilet. the user repeats this process until the affected skin is clean. Then the user closes the skin cleaner container, flushes the toilet and the user is done with this chore.

In some embodiments the purpose of the content of the kit is to moisturize the user's skin the container is called the moisturizer container, the pad is called the moisturizer pad, and the reservoir fluid is called lotion. After the user has used the toilet and cleaned the user's person, the user wets more dry toilet paper or the user's digits on this moisturizer pad. Then the user applies this fluid to the user's person to moisturize the user's skin after cleaning it. Afterwards, if the user has used toilet paper, the user disposes of this used toilet paper as well in the toilet, and flushes it away.

In some embodiments a container holds a fluid that performs more than one of the aforementioned tasks of cleaning a toilet seat or other surface, cleaning affected skin and moisturizing affected skin.

In some embodiments the fluid held in a container contains a component of water. In some embodiments it does not.

In some embodiments a fluid held in a container contains a component of soap. In some embodiments it does not.

In some embodiments a fluid held in a container contains a component of detergent. In some embodiments it does not.

In some embodiments a fluid held in a container contains a component of disinfectant. In some embodiments it does not.

In some embodiments a fluid held in a container contains a component of deodorant. In some embodiments it does not.

In some embodiments a fluid held in a container contains a component of analgesic. In some embodiments it does not.

In some embodiments a fluid held in a container contains a component of antiseptic. In some embodiments it does not.

In some embodiments a fluid held in a container contains a component of antibiotic. In some embodiments it does not.

In some embodiments a fluid held in a container contains a component of lubricant. In some embodiments it does not.

In some embodiments a fluid held in a container contains a component of emollient. In some embodiments it does not.

In some embodiments a fluid held in a container contains a component of perfume. In some embodiments it does not.

Replenishment

In some embodiments when the user has depleted the fluid in the pad in any of these containers, the user may replenish the fluid content of the pad by one of the following methods:

- The user deforms and pulls the pad out of the container and applies the fluid directly to the pad. Then the user puts the pad back in the container.
- The user opens the container and pours some volume of fluid directly into the pad, which absorbs it. Then the user closes the container again.
- The user opens the container and removes the pad from the chamber. Then the user adds a volume of fluid up to the file mark into the chamber. Then the user puts the pad back into the chamber. In some embodiments the interior of the container has visible on it a fill mark, which is a marking visible in the interior of the container and which goes around some or all of the interior of container and is parallel to a flat surface upon which the container rests. By design the fill mark indicates the maximum level to which to fill fluid into the container such that if after adding this volume of fluid to the container the user places a dry or almost dry pad in the container, the pad will absorb all of the fluid in the chamber.
- In some further embodiments there are two fill marks, indicating a maximum level to fill and a minimum level to fill.

Figure 7:
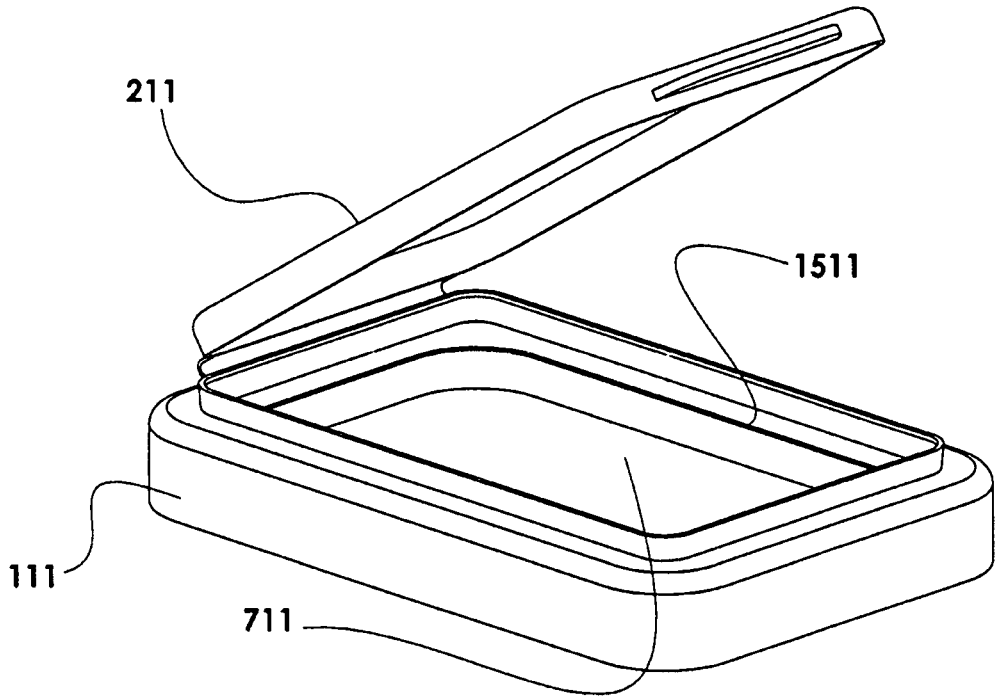
FIG. 7 shows a variant of the first embodiment where the container (111) has a fill line (1501) in its chamber (711) which is visible when the lid (211) is open.

In some embodiments the manufacturer or the user fills or replenishes the fluid in the pad by various means including:

- adding a particular weight of reservoir fluid to the pad
- inverting the container and filling the lid, either fully or up to some mark on the lid, with fluid; and then closing the container including the pad to cause absorption
- expressing reservoir fluid from purposed containers
- expressing fluid of a fixed volume from a syringe or drip device FIG. 7 shows an embodiment with a fill mark (1501) visible because the pad is not in the container (111).

Enhancement—Toilet Paper Pocket

In some embodiments the container also comprises, on its lid or some other exterior surface, a toilet paper pocket on it to carry some sheets of dry toilet paper. If the user wants to perform the functions of this device in a use facility where there is no toilet paper, the user uses the toilet paper from the toilet paper pocket container. Then, when the user has the opportunity, the user replenishes the toilet paper in the toilet paper pocket of the container.

Figure 5:
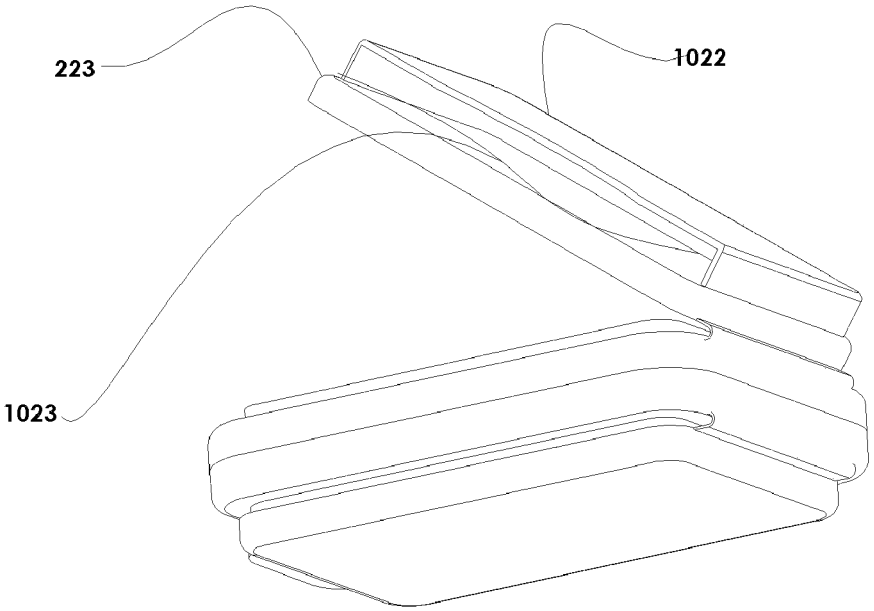
FIG. 5 illustrates a variant of the first embodiment where the container has two chambers, and one chamber has a toilet paper pocket (1022) on its lid (223). The space inside this pocket (1023) is shown empty but is adapted to hold toilet paper sheets.
Figure 6:
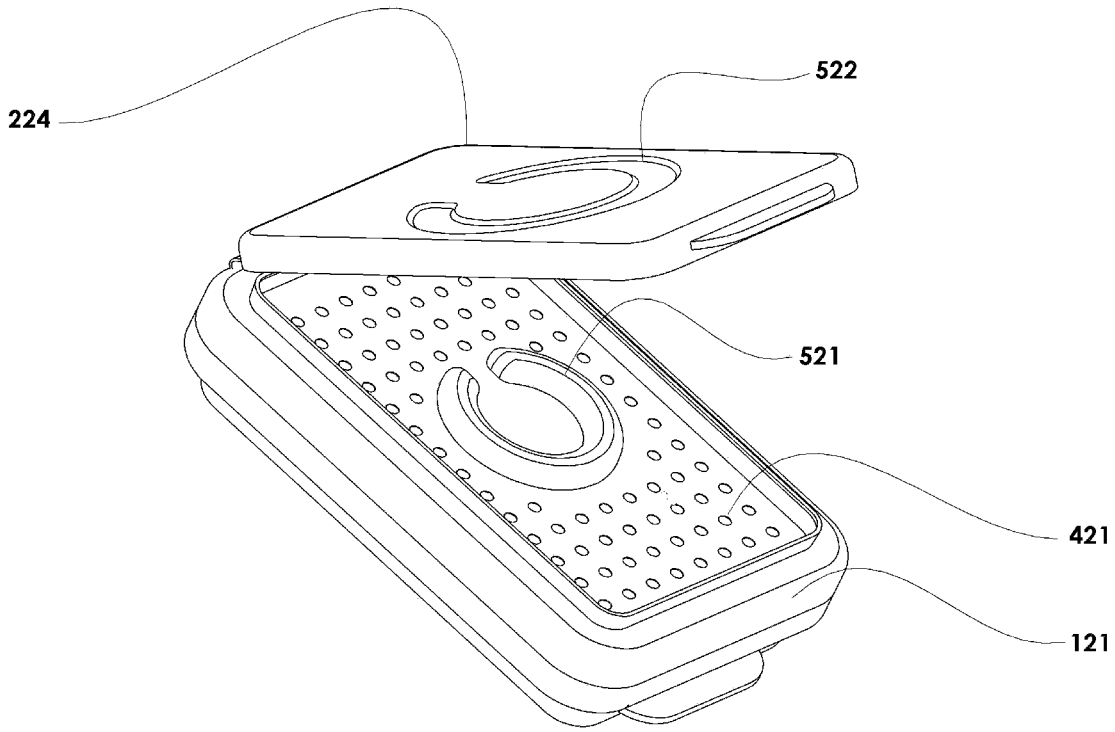
FIG. 6 shows a variant of the first embodiment where the container (121) has two chambers, and a design (522) is embossed on one lid (221). The pad (421) has embossed on it a design (521).

FIG. 5 shows an embodiment with a toilet paper pocket (1023) on one lid (222). This toilet paper pocket has a space (223) to hold toilet paper (not shown).

Enhancement—Visual and Tactile Cues

In some embodiments the containers and the absorbent pads are coded for identification, by labels, color codes, and Braille or other embossments. Also, in some embodiments different containers have different sizes and shapes. This aids the user in identifying what fluid each chamber in each container contains. Also it helps to prevent the user from mixing up the fluids for the different containers, and from using the wrong fluid for a particular purpose. Such labeling is well known and well understood in the art.

FIG. 5 shows an embodiment with markings and embossments (522) on a lid (221) and similar markings and embossments (521) on the pad (421).

Enhancement—Attaching the Device

In some embodiments the container is attached to a strap or a cord that the user may loop around an arm or a leg, thus securing the device to one's person. Such straps are well known and well understood in the Art. Thus securing the device precludes the need to set it down on some surface, which itself may not be clean. As the pad does not express fluid by gravity alone, the orientation of the container is irrelevant to its proper function. This independence of orientation distinguishes this invention from one that uses a squeeze bottle or a spray bottle, where orientation of the container would be relevant.

In some other embodiments the container a hook-and-loop mechanism pad on one surface. This mates with a corresponding hook-and-loop mechanism pad on some other surface, such as a backpack. When the user wants to carry the device using this feature, the user first attaches the hook-and-loop pads together, thus securing them. Such hook-and-loop mechanisms are well known and well understood in the art.

Enhancement—Lids

In some embodiments a lid is child-proof, so that children are less likely to contact inadvertently the fluid inside the container. In other embodiments a lid is not child-proof, for users who do not want a child-proof lid, since they do not contend with children and do not want the extra trouble of dealing with a child-proof lid. Such child-proof lids are well known and well understood in the art.

Also, various options exist for the lid itself. In some embodiments a lid attaches to the rest of the container by a hinge. In some embodiments a lid twists off the rest of the container. In some embodiments a lid attaches to the rest of the container by circumferential compression of the edge of the lid against the edge of the container. In some other embodiments a lid attaches to the rest of the container by some other mechanism. Many such options are well known and well understood in the art.

In some embodiments a lid is retained to the container by a hinge, a leash or a yoke, such mechanisms being well known and well understood in the art.

Enhancement—The Window

Figure 10:
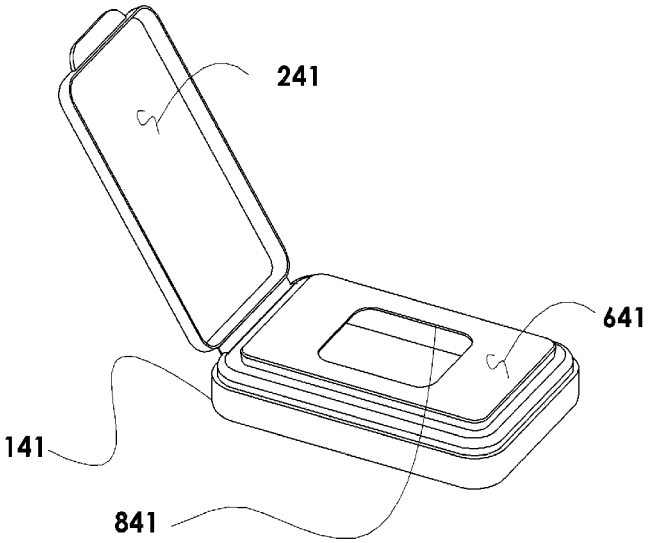
FIG. 10 shows an embodiment where the face (241) is separable from the rest of the container (141). The face (641) includes an opening, the aperture (841) and also a lid for the aperture (241).
Figure 11:
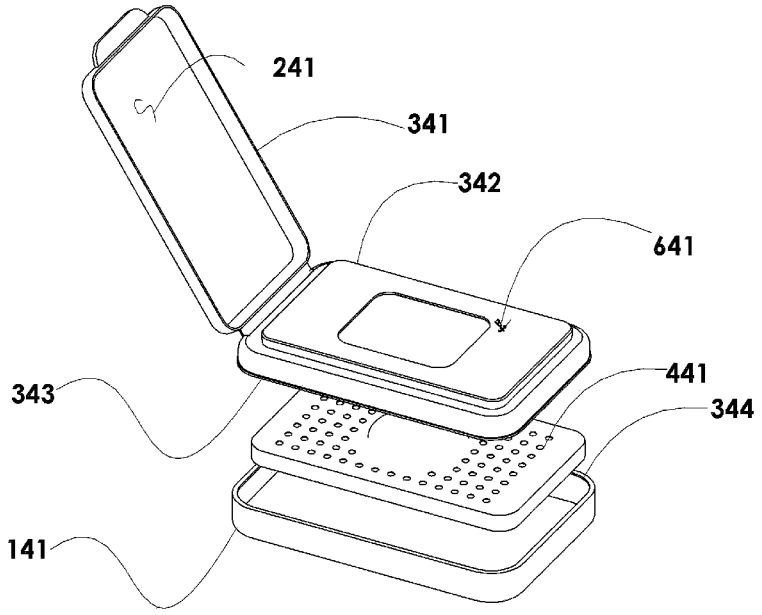
FIG. 11 shows the same embodiment as FIG. 10. Here the face (641) with its aperture (841) is shown separated from the rest of the container (141), and the pad (441) fits inside the chamber (344). The lid (241) has its edge (341) mate with the edge of the rest of the container (342) to form a leak-resistant seal. And the edge of the face (343) mates to the edge of the rest of the container (344) to form a leak-resistant seal. When removed the face (341) reveals an opening, the window (642).

In some embodiments, as seen in FIG. 10 and FIG. 11, one section of the container (141) called the face (641) separates from the rest of the container. This separation provides a gap called a window, which allows geometrically unconstrained access to the interior of a chamber, in that if the face of the container separates from the rest of the container and thus this window is open then there are no choke points between the pad (441) and the exterior of the container. In other words if the window is open then the pad can egress the container without deforming from its manufactured shape. The window attaches to the container when the edge of the window (343) meets the edge of the rest of the container (344) and shuts forming a leak-resistant seal.

In some further embodiments with such a face: In some embodiments the face attaches to the rest of the container by a hinge. In some embodiments the face twists free of the rest of the container. In some embodiments the face attaches to the rest of the container by circumferential compression of the edge of the face against the edge of the container. In some other embodiments the face attaches to the rest of the container by some other mechanism. Many such options are well known and well understood in the art.

In some embodiments a face is attached to the rest of the container by a hinge, a leash or a yoke, such mechanisms being well known and well understood in the art.

In some embodiments an aperture is located on a face. In some embodiments an aperture is not located on a face.

Enhancement—Combined Containers

In some embodiments a container has more than one chamber. Typically the different chambers contain pads that hold different fluids. For instance in an embodiment one chamber contains a pad that holds toilet cleaner fluid, and another chamber contains a pad that holds skin cleaner fluid. These chambers do not leak into each other.

Figure 3:
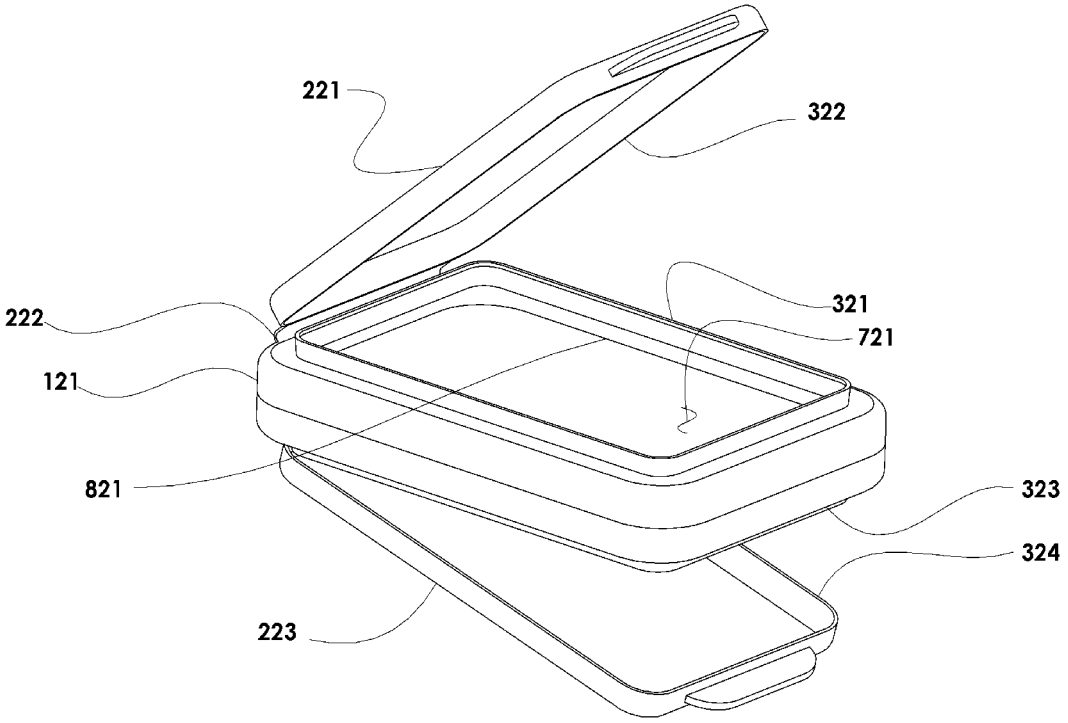
FIG. 3 illustrates a variant embodiment, the variation being the container (121) has two chambers. One of these chambers (721) is visible with no pad in it. This chamber (721) has its lid (221) visible, with rim (322) that matches the rim on the chamber (321). The hinge (222) of this rim is visible. The aperture (821) shows where the pad will be visible. The other chamber is not visible but has its lid (222) open.
Figure 4:
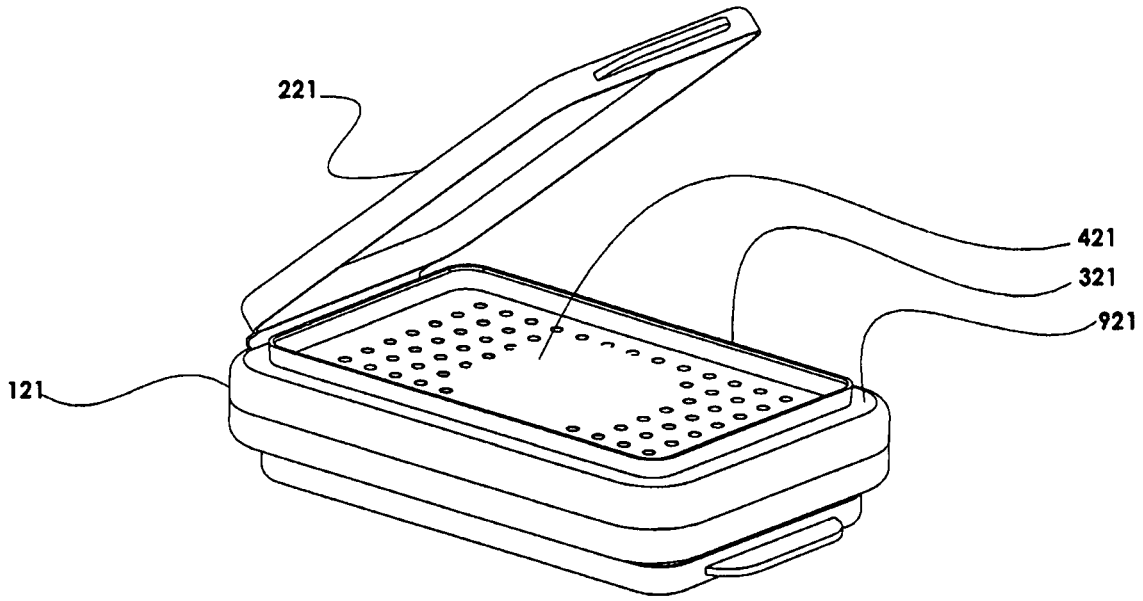
FIG. 4 illustrates the same exemplar as FIG. 3 but with pad (421) in the visible chamber. The choke point (921) keeps it in place. The lip on the chamber (321) is visible. The container (121) connects to the lid (221) of the visible chamber.

FIG. 3 and FIG. 4 show an embodiment where a container (121) that has two chambers, one of which is visible (721) and enclosed by a lid (221) which encloses a pad (421).

Enhancement—Different Venues

In different embodiments containers are adapted to different environments and uses. Some examples of this include:

- A user takes the kit to a public use facility in a first-world country. The toilet may need cleaning. But there is a low risk of infectious disease. Thus it is not crucial that the toilet cleaner fluid kill all microbes.
- A user takes the kit to a public use facility in a second-world or third-world country. Here the risk of infectious disease is higher. So the toilet cleaner fluid is adapted to killing most microbes on contact. Such fluids are well known and well understood in the art.
- A user takes the kit to cleanse his or her child's affected skin. Here the personal cleaner fluid needs to be adapted to cleanse the more sensitive affected skin of a very young child or other special-needs person.

Other Alternatives for the First Embodiment

In some embodiments each kit out of the toilet cleaner kit, the skin cleaner kit, and the moisturizer kit is physically separate. In some other embodiments these kits are physically joined into one object. In some other embodiments two of these kits are physically joined into one object and the third kit is physically separate.

In some embodiments the kits are of the size and dimensions given. In other embodiments the kits are of different shapes and dimensions such that the maximum diameter of a kit is between 0.5 and 8 inches, and the maximum thickness of a kit is between 0.1 and 1.5 inches.

In different embodiments with lids different areal fractions of one face of the absorbent pad are exposed when the lid is open, ranging between 5% and 100%.

In different embodiments with faces different areal fractions of one face of the absorbent pad are exposed when the face is open.

In some embodiments a pad is round. In some other embodiments a pad is rectilinear. In some other embodiments a pad is of some other shape.

In different embodiments a pad has different levels of malleability, from very soft to very stiff.

In some embodiments the pad does not of its own come out of the container due to the existence of a plurality of choke points between the chamber holding the pad and the aperture. This prevents the pad from slipping out of the container on its own even when the lid is open.

In some embodiments the choke point is a lip or an undercut around the inner wall of the container.

In some embodiments the choke point occurs because the chamber tapers towards the face of the container holding the aperture that exposes the pad; and also the manufactured shape of the pad is similar to that of the container itself, so that when the container contains the pad the pad also tapers towards the aperture. Thus both the container, and pad in all its possible positions within the chamber, have larger cross-sectional areas in some planes parallel to the plane of the aperture, than the aperture itself.

In some embodiments a pad fits snugly inside its chamber. In other embodiments it is loose.

In some embodiments the pad does not of its own come out of a container because the manufactured shape of the pad is larger than the transverse dimensions of the interior of the container, and the pressure the pad exerts upon the walls of the container hold the pad in place.

In some embodiments the pad does not of its own come out of a container because the surfaces of the container that touch the pad, and/or the surfaces of the pad that touch the container, are shaped and/or textured in a way that geometry and/or heightened friction prevent the pad from slipping against the container.

In some embodiments a pad does not of its own come out of a container for some combination of these elements.

In some embodiments the kits are all of the same shape and dimensions. In some other embodiments one of the kits is of a different shape and different dimensions from the other two kits. In some other embodiments all three of the kits are of different shapes and/or dimensions.

Of the three container types presented here; the toilet cleaner container, the skin cleaner container and the moisturizer container: In some embodiments just one of these container types is present. In some other embodiments only two of these container types are present. And in some other embodiments all three of these container types are present.

In some embodiments an absorbent pad is made of foam elastomer. In some other embodiments an absorbent pad is made of cellulose. In some other embodiments an absorbent pad is made of the skeletal structure of an animal of the sponge family, commonly called a sponge. In some other embodiments an absorbent pad is made of some other compressible or resilient absorbent material.

In some embodiments an absorbent pad expands when it absorbs fluid, and in some embodiments it does not. In some embodiments an absorbent pad shrinks when it expresses fluid, and in some embodiments it does not.

The degree of resilience of an absorbent pad varies with different embodiments from soft to stiff. The degree of resilience in all embodiments is such that the user may press toilet paper against a pad and thereby express fluid from that pad onto the toilet paper.

In different embodiments the absorbency of the pad varies as a function of pad material and manufacture.

In some embodiments the container has a leak-resistant lid which hinges open and closed. In some other embodiments the container has a twist-on leak-resistant lid which the user unscrews to open and screws on again to close. In some other embodiments the container has some other kind of leak-resistant lid, such leak-resistant lids being well understood in the art.

In some embodiments a lid of a container has one latch. In some embodiments a lid of a container has more than one latch.

In some embodiments a lid is latched to the rest of its container by friction and mechanical compression of the sealing lips of the container and the lid. In some embodiments a lid is not latched to its container by this method.

In embodiments where a container has more than one chamber: In some such embodiments more than one chamber share a lid. In some such embodiments each chamber has its own separate lid.

In some embodiments a chamber has a face. In some embodiments a chamber has no face.

In some embodiments where a chamber has a face that face is attached to the rest of the container by friction and mechanical compression of the sealing lips of the container and the lid. In some embodiments a face is not attached to the rest of the container by this method.

In some embodiments the toilet cleaner fluid is simply water. In some embodiments the toilet cleaning fluid is a fluid compounded specifically to clean and to disinfect surfaces, such fluids being well understood in the art. In some embodiments the toilet cleaning fluid is some other substance.

In some embodiments the skin cleaner fluid is simply water. In some embodiments the skin cleaner fluid is a solution compounded specifically to clean a person's affected skin, and comprises substances drawn from the set of soap, perfumes, and disinfectants. In some embodiments the skin cleaner fluid is some fluid adapted to cleaning the user's person, such fluids being well understood in the art.

In different embodiments the composition of lotion varies as per individual needs and desires, such lotions being well understood in the art. Such lotions may include substances drawn from the set of moisturizing oils, vitamins and other nutrients, fragrance, and medications.

In some embodiments the toilet cleaner fluid and the skin cleaner fluid are combined as a single mixture. In some embodiments they are not combined.

In some embodiments the skin cleaner fluid is adapted to use on infants, such fluids being well known and well understood in the art. In some embodiments it is not.

In some embodiments the toilet cleaner fluid is adapted to kill all microbes on contact. In some embodiments the toilet cleaner fluid is not specifically adapted to kill microbes. In some embodiments the toilet cleaner fluid is adapted to kill specific microbes on contact specifically to prevent the spread of particular identified pathogens.

In some embodiments the lid of the container is child-proof, in some other embodiments it is child-resistant, and in some other embodiments it is neither child-proof nor child-resistant. Child-proof and child-resistant caps are well known and well understood in the art.

In some embodiments a lid of the container is twist-off. In other embodiments it is not.

In some embodiments the container has a toilet paper pocket to hold toilet paper. In some embodiments the container has no toilet paper pocket. In some further embodiments the toilet paper pocket is stiff. On other embodiments the toilet paper pocket is flexible. In some embodiments the toilet paper pocket may be closed with a zipper, a plurality of buttons, or some other mechanism, such mechanisms being well understood in the art. In some other embodiments the toilet paper pocket has no such mechanism to seal it.

In some embodiments the container is stiff. In some embodiments the container is flexible. In some embodiments the container is stiff on the outside but contains a flexible inner chamber.

In some embodiments different containers are distinguishable by color. In some other embodiments they are not.

In some embodiments different absorbent pads are distinguishable by color. In some other embodiments they are not.

In some embodiments different containers are distinguishable by writing or other markings. In some other embodiments they are not.

In some embodiments different absorbent pads are distinguishable by writing or other markings. In some other embodiments they are not.

In some embodiments different containers are distinguishable by Braille embossments or other embossments. In some other embodiments they are not.

In some embodiments different absorbent pads are distinguishable by Braille embossments or other embossments. In some other embodiments they are not.

In some embodiments there is a fill mark. In some further embodiments there are two fill marks, one to indicate a maximum level and another to indicate a minimum level to fill. In some other embodiments there is no fill mark.

In some embodiments the fill mark is a line that goes all around the interior of the container. In some other embodiments the fill mark comprises a plurality of disjoint markings on the interior of the container.

In some embodiments the file mark is parallel to the surface on which the container rests. In other embodiments it is not.

In some embodiments the exterior of the container is cylindrical. In some other embodiments the exterior is concave. In some other embodiments the exterior is convex. In some other embodiments it is some other geometric shape.

In some embodiments the user purchases the kit and the fluid separately. In such embodiments the user may use any fluid the user wishes in the kits.

We show these embodiments, environments and uses to be demonstrative and exemplary and not limiting. Embodiments may occur in combination with other apparatuses, some part of which function as this invention. Many and unlimited variations of this invention may arise without departing from its spirit, or sacrificing its advantages.

SECOND EMBODIMENT

Figure 8:
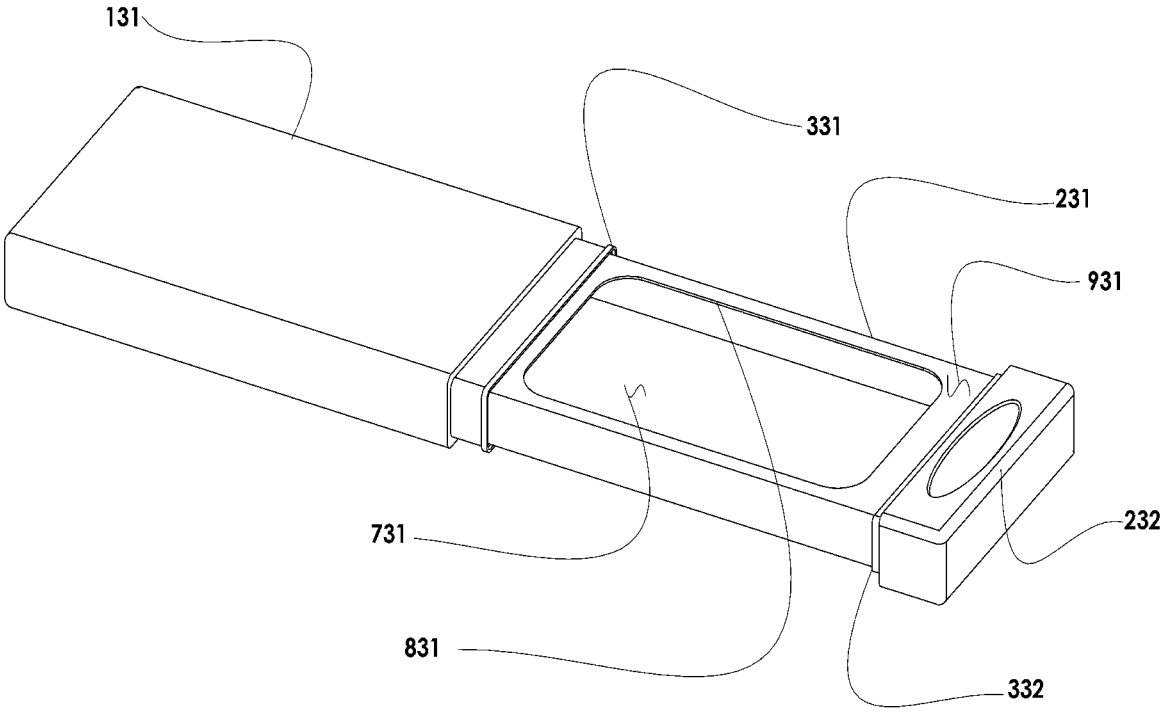
FIG. 8 shows an embodiment of the second embodiment where the container (131) has the internal sleeve (231) slide out. When the internal sleeve is shut the lip of the container (331) will touch the lip of the internal sleeve (332) to form a leak-resistant seal. The end of the internal sleeve (232) is adapted to be manually grabbed by the user to push the internal sleeve into or out of the container. The choke point (931) will keep a pad in the chamber (731) from falling out through the aperture (831).
Figure 9:
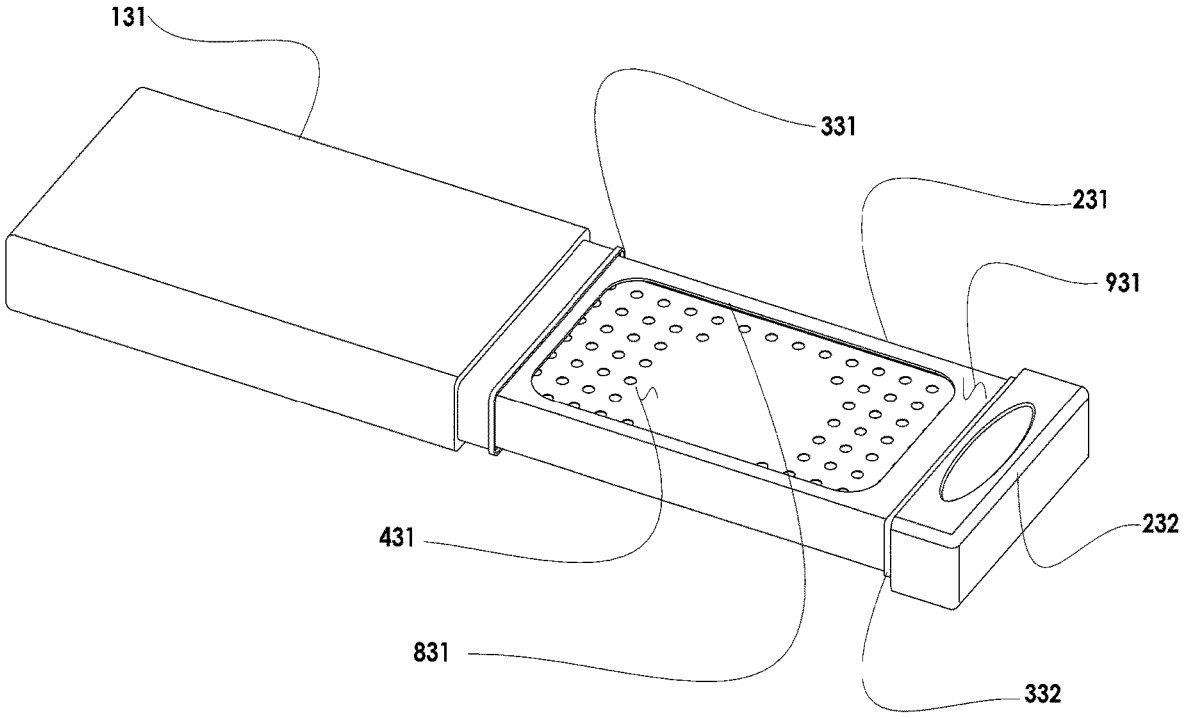
FIG. 9 shows the same embodiment as FIG. 8 but with the pad (431) in the chamber.

Another embodiment as shown in FIG. 8 and FIG. 9, has the same functionality as the first embodiment. However, instead of a rectangular container with an opening that contains a pad, an internal sleeve (231) slides out of the container (131). The internal sleeve holds the pad (431) in its chamber (731). The container has a rim (332) that mates with the rim of the internal sleeve (332) to form a leak-resistant seal. The internal sleeve has a choke point (931) which prevents the pad from coming out of the internal sleeve without deforming.

To use the pad the user grasps the head of the internal sleeve (232) and slides the internal sleeve out of the container. When the internal sleeve reaches the full extent of its travel it latches into place due to a detent mechanism (not shown) not requiring anything but applied force in the closing vector to accomplish closure and sealing, such detent mechanisms being well understood in the art. Thus once the user pulls the internal sleeve out to the full extent of its travel the internal sleeve does not move from this position unless the user applies some force to push the internal sleeve back into the container.

Once the internal sleeve is fully extended the user applies toilet paper to the pad inside the internal sleeve, exactly as the user does for the first embodiment.

Alternatives for the Second Embodiment

In some embodiments the internal sleeve has a detent mechanism. In some other embodiments the internal sleeve does not.

In different embodiments with internal sleeves different areal fractions of one face of the absorbent pad are exposed when the internal sleeve is open, ranging between 5% and 100%.

In some embodiments there is some mechanical force potential inside the internal sleeve such as a spring naturally pushing it out. In some other embodiments there is not.

In some embodiments the internal sleeve is stiff. In some other embodiments the internal sleeve is flexible, and in such embodiments the user may squeeze the extended internal sleeve to express fluid directly from the internal sleeve and the contained resilient pad without pressing toilet paper directly onto the resilient pad. This is similar in spirit and design to a squeeze-bottle bag. The fluid is prevented from being expressed when the internal sleeve is secured completely within the stiff container.

Apart from the opening mechanism for the container: All of the properties of the first embodiment, and all of the alternatives of the first embodiment, also apply to the second embodiment.

Again we show these embodiments, environments and uses to be demonstrative and exemplary and not limiting. Embodiments may occur in combination with other apparatuses, some part of which function as this invention. Many and unlimited variations of this invention may arise without departing from its spirit, or sacrificing its advantages.

Advantages

This approach has several advantages both over what people normally do, and over the prior art.

One advantage of this approach is that the small rectangular container may be sized to fit in the user's pocket, purse, suitcase or backpack; the user may have it on the user's person at all times.

Second, the container-plus-pad approach has advantages over a bottle for carrying fluid in that if the seal on the bottle fails the bottle will naturally leak in some positions, but even if the seal on the container fails when the pad is inside the container, the pad will not naturally express fluid unless force and compression act on it. Therefore even if the container breaks mechanically the fluid contents will not naturally flow out, although in such a container fluid may leak over time. Also in the situation where the user has access to no toilet paper at all, the user can pull out the pad itself from the container and use it to clean in lieu of toilet paper, as is the case with a pre-moistened wipe. This is impossible with a bottle.

Third, this approach enables the user to use the toilet paper the user finds in nearly all toilet areas, without having to carry around the user's own pre-moistened wipes. Thus the approach is universal. The user may use it whenever and wherever the user uses the toilet. And in those containers the user does not find toilet paper, the user carries the user's own toilet paper.

Fourth, moistening toilet paper with fluid leads to the user being able to clean the toilet seat, and the user's person, more thoroughly that is possible with just dry toilet paper.

Fifth, using the commonly occurring toilet paper, which is known to degrade quickly in water, is better for sewage systems than using pre-moistened wipes which are manufactured to survive remaining moist without degrading and therefore do not degrade in sewage systems, thereby clogging those sewage systems.

Sixth, the container and pad are economic and easy to manufacture. And the various fluids to fill the container already exist. So manufacturing these complete kits will be trivial. This enhances the merchantability of this approach.

Seventh, this method allows the user to start with a fresh piece of dry toilet paper for each different operation. And the containers are leak-resistant from each other. So this method lowers the possibility of cross-contaminating skin contact between different fluids and substances, from the containers, from the toilet, or from the user.

The first embodiment has the advantage over the second embodiment that it is simpler to manufacture, having fewer mechanical parts, and also for the same reason less prone to break in is use functionality, and thus remain intact in its use.

CONCLUSION

One skilled in the art will see that the uses and sequences of usage of the described invention are many, and that the embodiments shown are not limiting but rather representative of many other uses to which one may put this invention.

All in all this invention will make life easier, cheaper, cleaner and more hygienic for users of toilets, since they may clean themselves more thoroughly with minimal effort. And it will be a boon to sewage systems, since it will encourage—by lower cost than pre-moistened wipes, by higher availability than pre-moistened wipes, and by a broader choice of fluids than pre-moistened wipes provide—enabling those toilet users to employ fluids selected for use and existing toilet paper, which breaks down in a sewage system, rather than prepackaged pre-moistened wipes which do not have these advantages.

We claim:

1. An apparatus comprising:

a) a container which spatially encloses a hollow enclosure;

b) a reservoir which:

<i> comprises an object made of absorbent material adapted to hold a fluid;

<ii> resides in said hollow enclosure of said container; and

<iii> has the property that when some other absorbent object is pressed against said reservoir then the fluid held in the reservoir transfers from the reservoir to said other absorbent object;

c) the fluid held in said reservoir and comprising a plurality of substances drawn from the following set:

<i> soaps;

<ii> detergents;

<iii> disinfectants;

<iv> deodorants;

<v> analgesics;

<vi> antiseptics;

<vi> antibiotics;

<vii> lubricants;

<viii> emollients; and

<ix> perfumes;

where:

e) an interior of the container has a fill mark, where said fill mark is visible to a person; said fill mark being adapted to indicate the maximum level up to which the container may be filled such that the reservoir, when dry, placed thereafter in said container will completely absorb said fluid; and where said fill mark directs a person to fill said container with said fluid up to its level and no higher; thereby warning said person not to overfill said container;

f) said container has an aperture which is covered by a lid where:

<i> said lid is adapted to be opened and closed manually;

<ii> when said lid is closed said enclosure is leak-resistant for fluids and said container entirely contains said reservoir;

<iii> when said lid is open said aperture exposes all or some fraction of a surface area of said reservoir;

wherein the apparatus is configured to permit a user to carry said fluid on their person.

2. The container of claim 1 having a plurality of qualities drawn from the following set:

b) having on its surface visual markings;

c) having on its surface writing; and d) having on its surface embossments.

3. The reservoir of claim 1 having a plurality of qualities drawn from the following set:

b) having on its surface visual markings;

c) having on its surface writing; and d) having on its surface embossments.

4. The apparatus of claim 1 where said container has a section that separates from the rest of said container, providing external exposure to the enclosure which holds said reservoir; such that when said section is separate from the rest of said container, said reservoir is able to travel into and out of said enclosure without deforming from its manufactured shape.

* * * * *